United States Patent [19]

Seidler

[11] Patent Number: 4,795,218

[45] Date of Patent: Jan. 3, 1989

[54] METHOD OF FORMING BRUSH WITH INTEGRAL HOLDER

[76] Inventor: David Seidler, 69-10 108th St., Forest Hills, N.Y. 11375

[21] Appl. No.: 912,295

[22] Filed: Sep. 29, 1986

[51] Int. Cl.[4] ..... A46D 3/00

[52] U.S. Cl. ..... 300/21; 15/159 A; 264/243; 425/805

[58] Field of Search ..... 300/2-11, 300/21; 264/243, 263, 248, 138, 157, 312; 425/805; 15/104.92, 159 A; 401/288

[56] References Cited

U.S. PATENT DOCUMENTS 2,672,640 3/1954 Peterson et al. ..... 264/243 X 3,499,686 3/1970 Landen et al. ..... 300/21

*Primary Examiner*—Mark Rosenbaum

*Attorney, Agent, or Firm*—Blum Kaplan

[57] ABSTRACT

A method of forming a brush from a plurality of thermoplastic bristle filaments. The steps of the method include inserting the plurality of thermoplastic bristle filaments into a hollow mold tube, moving a hole former pin into a first end of the bristles, and heating the mold tube adjacent the first end of said bristles to melt the first end of the thermoplastic bristle filaments around the pin. The steps also includes cooling the mold tube, extracting the first end of the filaments out of the mold tube and extracting the pin out of the first end of said bristle filaments, whereby a brush having a hollow brush holder is formed for use.

16 Claims, 4 Drawing Sheets

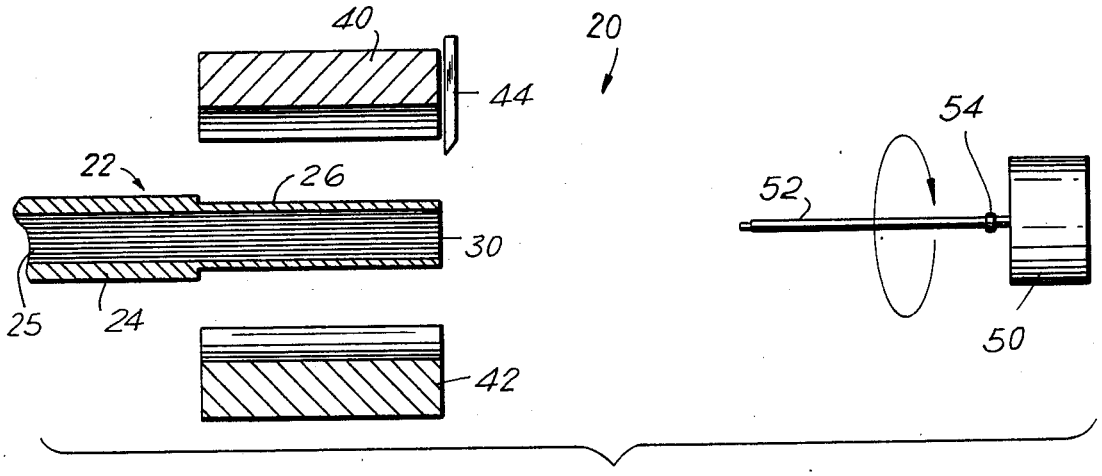
FIG. 1
FIG. 2
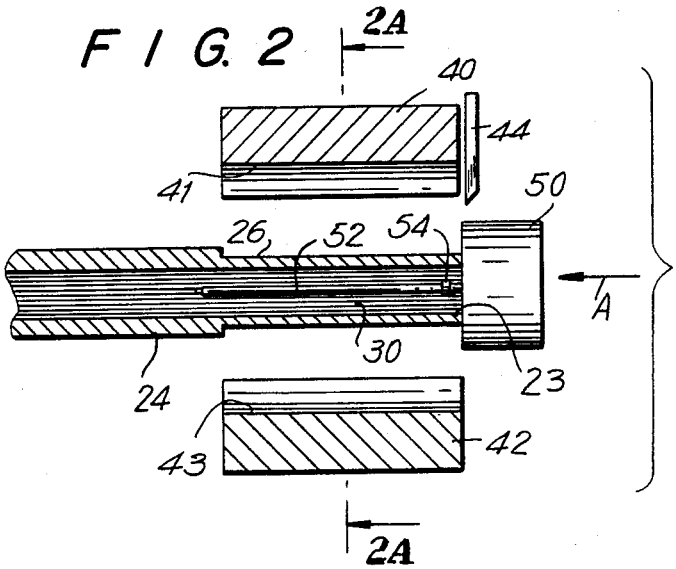
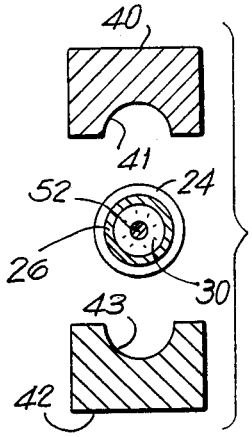
FIG. 2A
FIG. 3
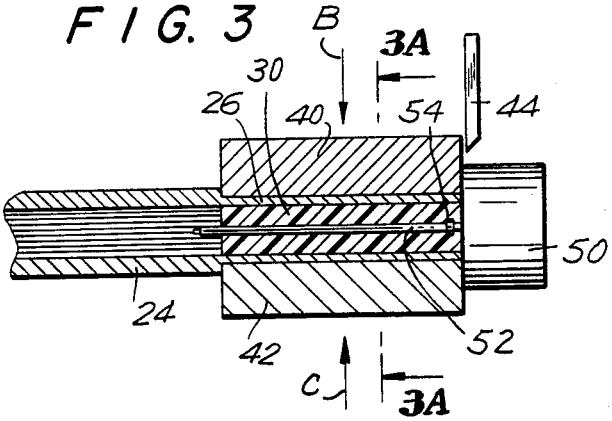
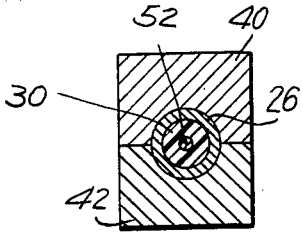
FIG. 3A

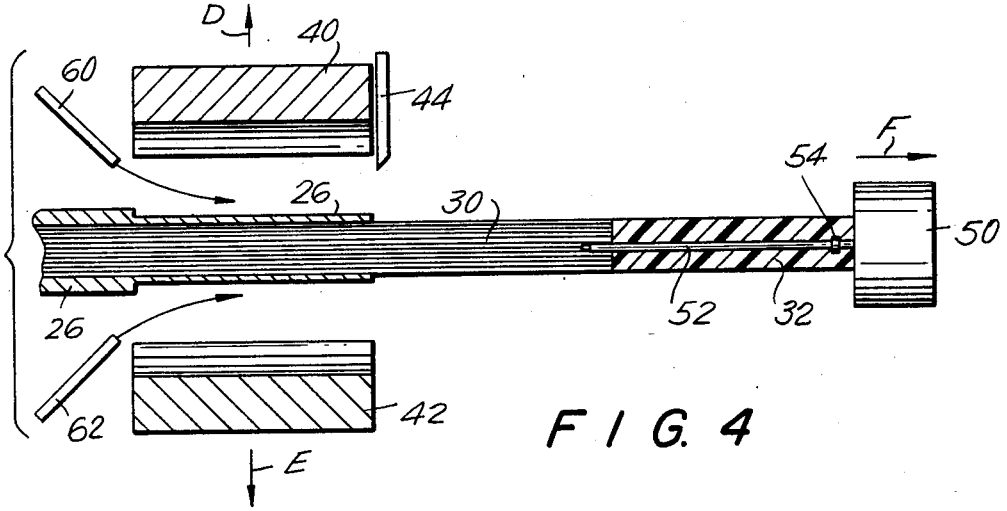
FIG. 4
FIG. 5
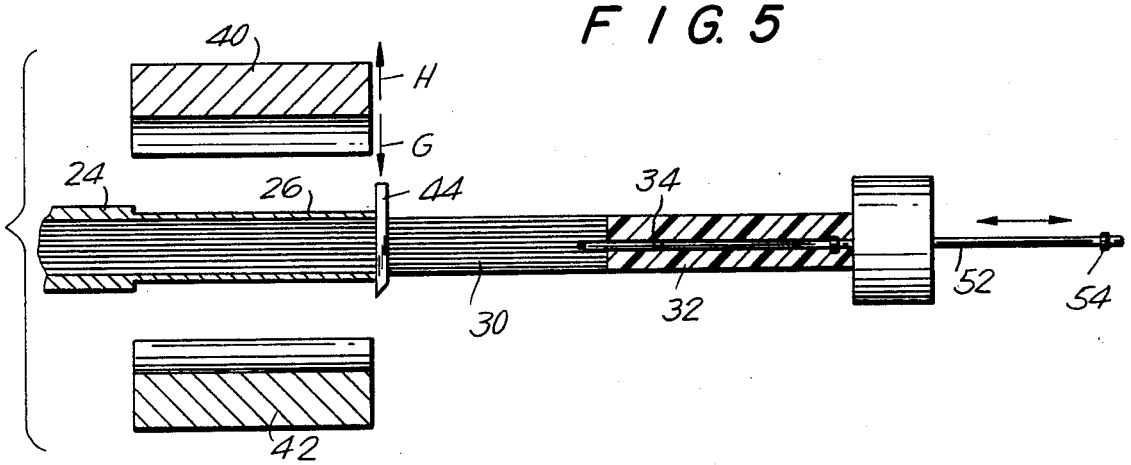
FIG. 6
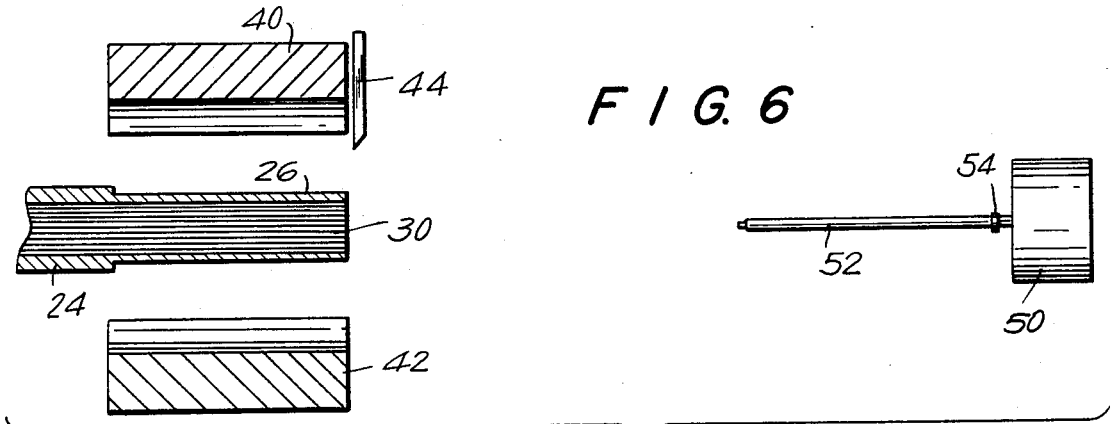
FIG. 7
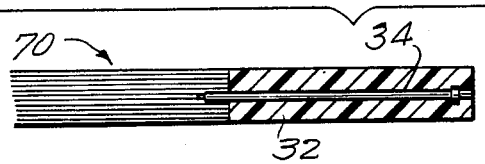

FIG. 8
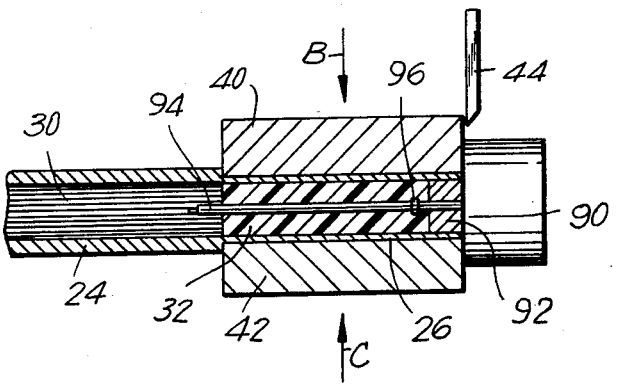
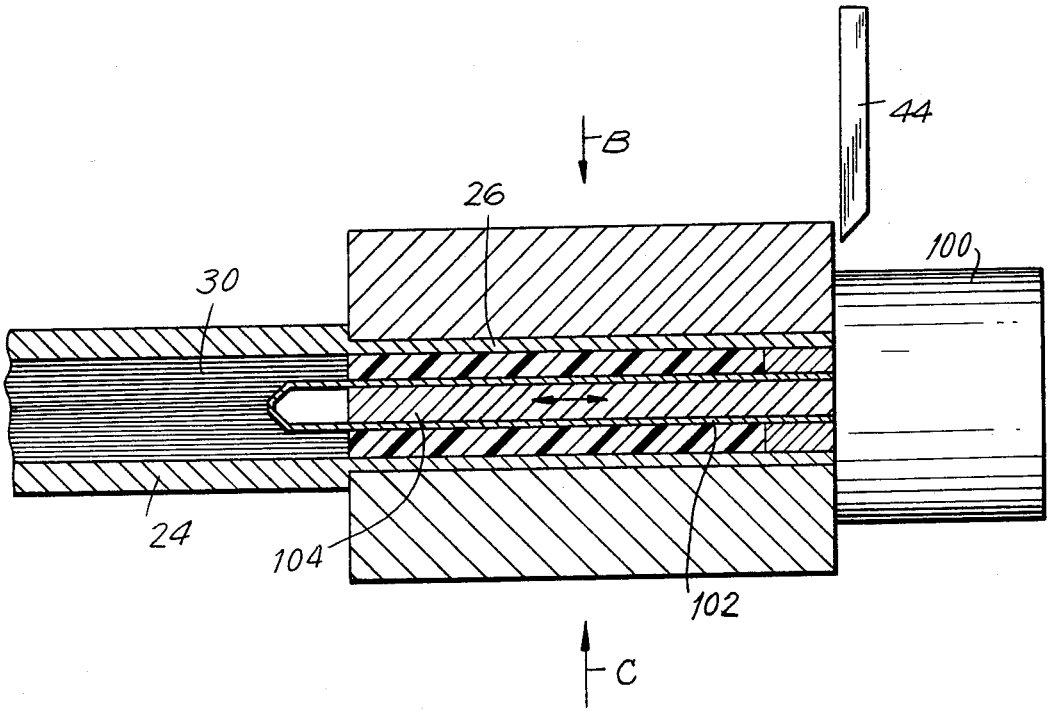
FIG. 9

METHOD OF FORMING BRUSH WITH INTEGRAL HOLDER

BACKGROUND OF THE INVENTION

The present invention is directed generally to a method of forming a brush and, in particular, to a method of forming a brush of thermoplastic filaments which includes an integrally formed holder.

Many occasions arise such as in liquid or other fluid applications where a brush is desired to be held on an applicator device. It may also be desired to permit the product to flow through and along the bristle elements of the brush. For example, it may be desirable to have a brush with a hollow holder whereby fluid such as nail polish is provided to the brush bristles through the hollow holder.

In my co-pending U.S. patent application Ser. No. 06/873,007 filed on June 11, 1986 and entitled NAIL ENAMEL PEN, I disclose a new nail enamel pen in which a brush having a hollow holder is utilized. In particular, nail polish in the container bottle flows through the hollow brush holder onto the bristles extending from the brush holder. The holder acts both to permit nail polish to flow therethrough and as a means whereby the brush is held on the nail enamel pen.

Accordingly, it is desired to provide a method whereby a brush having a holder formed integrally therewith can be manufactured easily and inexpensively.

SUMMARY OF THE INVENTION

Generally speaking, in accordance with the present invention, a method of forming a brush from a plurality of thermoplastic bristle filaments is provided. The method includes the steps of inserting the plurality of thermoplastic bristle filaments in a mold tube having a first end and a second end, and heating the mold tube adjacent the first end of the bristles filaments to melt a portion of the filaments to form a holder. The steps of the method further comprise cooling the mold tube and extracting the molded filaments out of the mold tube, and cutting the filaments to form a brush with integral holder.

In a preferred embodiment, a hole former pin is inserted in the first end of the bristles before heating to permit a through hole to be formed in the holder when the melted bristles are cooled. The mold tube may include a first section having a relatively thick wall and a second section having a thin wall where heat is applied to melt the bristle filaments to form the hollow holder. The hole former pin may rotate to assist in insertion and removal from the bristle filaments.

Accordingly, it is an object of the present invention to provide a method of forming a brush having an integral brush holder.

Another object of the present invention is to provide a method of forming a brush from thermoplastic filaments which includes a hollow brush holder formed integrally with the bristles.

A further object of the present invention is to provide a method of forming a brush with brush holder which is easy to follow, includes a minimal amount of steps and which produces a superior brush with brush holder.

Yet another object of the present invention is to provide an improved brush with integral holder for use in liquid applicators.

Still other objects and advantages of the invention will in part be obvious and will in part be apparent from the specification.

The invention accordingly comprises the several steps and the relation of one or more of such steps with respect to each of the others, and the article possessing the features, properties and the relation of elements, which are exemplified in the following detailed disclosure, and the scope of the invention will be indicated in the claims. cl BRIEF DESCRIPTION OF THE DRAWINGS For a fuller understanding of the invention, reference is had to the following description taken in connection witht he accompanying drawings, in which:

FIG. 1 is a front elevational sectional view showing an apparatus for performing the method steps according to the present invention in the first stage thereof;

FIG. 2 is a view similar to FIG. 1 but showing a further step in the method of the present invention where the pin hole former is moved into place;

FIG. 2A is a sectional view taken along line 2A—2A of FIG. 2;

FIG. 3 is a view similar to FIG. 2 but showing a further step in the method where the heaters are moved into place;

FIG. 3A is a sectional view taken along line 3A—3A of FIG. 3;

FIG. 4 is a further view showing the next step in the method according to the present invention where cooling takes place;

FIG. 5 is a view showing another step in the method whereby the cutter is displaced;

FIG. 6 is a view similar to FIG. 1 showing the completion of the method steps with the apparatus now ready for a new sequence;

FIG. 7 is a sectional view showing a brush with hollow brush holder constructed according to the method of the present invention;

FIG. 8 is a front elevational sectional view showing an alternative apparatus construction for use in connection with the present method;

FIG. 9 is an enlarged view showing another alternative embodiment of apparatus used in the method of the present invention.

DESCRIPTION OF THE PREFERRED EMBODIMENTS

Figure 10A:
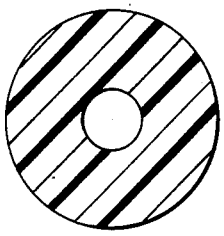
FIGS. 10 through 13B show other configurations for alternative brush shapes with and without hollow brush holders formed according to the method of the present invention.
Figure 11A:
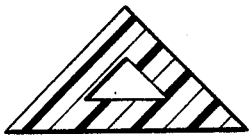
Figure 10B:
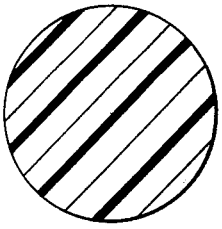
Figure 11B:
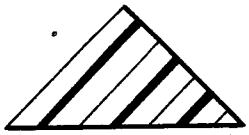
Figure 12A:
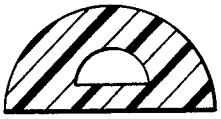
Figure 13A:
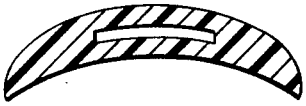
Figure 12B:
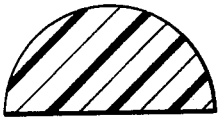
Figure 13B:
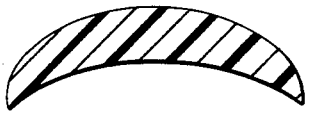

Reference is first made to FIG. 1 which depicts an apparatus, generally indicated at 20, which is used to perform the method of brush forming according to the present invention. Apparatus 20 includes a mold tube generally indicated at 22 having a first thickened end 24 and a second thin wall end 26. Elongated bristles 30, formed from a thermoplastic material such as nylon, polyethelene, or any other appropriate olefin, in a conventional manner are fed into the hollow opening 25 of mold tube 22 from an appropriate source (not shown).

Apparatus 20 also includes a first shaped heater 40, a second shaped heater 42 and a cutter element 44. A hole former 50 including an elongated hole former pin 52 having a flange or overcut 54 is provided. In an alternative embodiment, hole former unit 50 can be provided so as to rotate hole former pin 52 during operation to ease in insertion and removal.

Reference is now made to FIGS. 2 and 2A in order to describe the next step in the method once the bristles have been properly inserted and positioned longitudinally in mold tube 22. As shown in FIGS. 2 and 2A, hole former unit 50 is moved in the direction of arrow A such that pin 52 is inserted into bristles 30 through open end 23 of tube 22.

Referring now to FIG. 3, it is seen that heater members 40 and 42 are moved respectively in the direction of arrows B and C so as to contact thin wall portion 26 of tube 22. As shown in FIGS. 2A and 3A, heater unit 40 includes a shaped portion 41 and heater unit 42 includes a shaped portion 43 which conform to the shape of the thin wall portion 26 of mold tube 22. Heat is transferred through the thin mold tube wall 26 thereby melting the thermoplastic bristle filaments around hole former pin 52.

Referring now to FIG. 4, it is seen that heating members 40 and 42 are moved away respectively in the direction of arrows D and E to thereby remove the heating source from the mold tube. The shaped heater halves thereby retract to their original position. Cool air jets 60 and 62 cool the thin wall portion 26 of mold tube 22 thereby hastening solidification of the melted bristles to conform to the shape of the mold tube. Thereafter, hole former assembly 50 is retracted in the direction of arrow F thereby pulling out the newly formed brush holder and bristles filaments. The flange 54 on hole former pin 52 acts to assist in withdrawing the formed tube holder with attached filaments from mold tube 22.

Referring now to FIG. 5, it is seen that cutter 44 is moved in the direction of arrow G when the length of bristles 30 have reached the appropriate position. Hole former pin 54 retracts from newly formed brush holder 32 as depicted in FIG. 5 thereby stripping itself from the fused bristle section holder 32 and leaving a formed passage way or through hole 34.

FIG. 6 depicts the unit as depicted in FIG. 1 ready for the next forming operation. FIG. 7 depicts a brush generally indicated at 70 constructed in accordance with the present method. Brush 70 includes bristles 30 and formed brush holder 32 having a slot 34 formed therein in the manner described above. Brush 70 can be used in a liquid applicator such as a nail enamel pen whereby liquid will flow through opening 34 onto bristles 30.

Reference is now made to FIG. 8 which depicts an alternative embodiment of the present invention whereby hole former unit assembly 90 includes an annular projection 92 which acts as a piston to compress the melted plastic and decrease air bubbles in the fused brush holder 32. Hole former assembly 90 also includes a pin 94 with flange 96 as described above.

FIG. 9 depicts an alternative embodiment whereby hole former unit 100 includes a hole former pin assembly 102 which includes an internal heating element 104 to assist in melting and fusing the bristle portions to form the brush holder.

FIGS. 10A through 13B depict various brush shapes which may be formed with the method of the present invention, but it is noted that the present invention could form many other shapes. FIG. 10A depicts the circular brush holder with central opening. FIG. 10B shows a solid brush holder wherein hole former assembly 52 would not be utilized. FIGS. 11A and 11B show triangular shapes both with and without internal openings. FIGS. 12A, 12B, 13A and 13B show other alternative brush shapes both with and without central openings.

The method according to the present invention provides a brush with integral brush holder which is relatively inexpensive to manufacture yet meets all of the benefits and advantages noted above. The brush holder may be hollow or solid, depending upon the requirements of the user.

It will thus been seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. A method of forming a brush with an integral holder capable of being held from a plurality of thermoplastic bristle filaments comprising the steps of inserting said plurality of thermoplastic bristle filaments into a hollow mold tube, moving a hole former pin into a first end of said bristle filaments, heating said mold tubee adjacent said first end of said bristle filaments to melt said first end of said thermoplastic bristle filaments around said pin to form said integral holder, cooling said mold tube, extracting said first end of said bristle filaments out of said mold tube and extracting said pin out of said first end of said bristle filaments, whereby a brush having a hollow brush holder integrally formed therewith and capable of being held is formed for use.

2. The method as claimed in claim 1, wherein said mold tube includes a first portion and a second portion, said first portion being thinner than said second portion, said first end of said bristle filaments extending in said first portion of said mold tube.

3. The method as claimed in claim 2, wherein said heat is applied to said first portion of said mold tube.

4. The method as claimed in claim 1, wherein said hole former pin is rotated.

5. The method as claimed in claim 1, wherein said hole former pin includes a flange which engages said melted bristle filaments.

6. The method as claimed in claim 1, further comprising the step of cutting said bristle filaments at a desired length.

7. The method as claimed in claim 1, further comprising the step of compressing said bristle filaments during heating.

8. The method as claimed in claim 1, wherein said hole former pin itself applies heat to said first end of said bristle filaments.

9. A brush with integral hollow brush holder formed according to the method of claim 1.

10. A brush with integral hollow brush holder formed according to the method of claim 5.

11. A method of forming a brush with an integral holder capable of being held from a plurality of thermoplastic bristle filaments comprising the steps of inserting said plurality of thermoplastic bristle filaments into a hollow mold tube, heating said mold tube adjacent a first end of said bristles to melt said first end of said thermoplastic bristle filaments to form said integral holder, cooling said mold tube, and extracting said first end of said filaments out of said mold tube, whereby a brush having an integral brush holder capable of being held is formed for use.

12. The method as claimed in claim 11, wherein said mold tube includes a first portion and a second portion, said first portion being thinner than said second portion, said first end of said bristle filaments extending in said first portion of said mold tube.

13. The method as claimed in claim 12, wherein said heat is applied to said first portion of said mold tube.

14. The method as claimed in claim 11, further comprising the step of cutting said bristle filaments at a desired length.

15. The method as claimed in claim 11, further comprising the step of compressing said bristle filaments during heating.

16. A brush with integral brush holder formed according to the method of claim 11.

* * * * *